US008757771B2

(12) United States Patent
Tsuchii et al.

(10) Patent No.: US 8,757,771 B2
(45) Date of Patent: Jun. 24, 2014

(54) LIQUID EJECTION HEAD AND LIQUID EJECTING APPARATUS

(75) Inventors: Ken Tsuchii, Sagamihara (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 13/443,089

(22) Filed: Apr. 10, 2012

(65) Prior Publication Data

US 2012/0274703 A1 Nov. 1, 2012

(30) Foreign Application Priority Data

Apr. 28, 2011 (JP) ..... 2011-101235

(51) Int. Cl.
*B41J 2/15* (2006.01)

(52) U.S. Cl.
USPC ..... 347/40; 347/20; 347/41; 347/42; 347/43

(58) Field of Classification Search
USPC ..... 347/20, 40–43
See application file for complete search history.

(56) References Cited

U.S. PATENT DOCUMENTS

| | | | |
|---|---|---|---|
| 6,766,579 | B2 | 7/2004 | Ohkuma |
| 6,830,317 | B2 | 12/2004 | Tsuchii et al. |
| 7,591,531 | B2 | 9/2009 | Tsuchii et al. |
| 7,784,904 | B2 | 8/2010 | Ide et al. |
| 7,909,432 | B2 | 3/2011 | Tsuchii et al. |
| 7,926,917 | B2 | 4/2011 | Tsuchii et al. |
| 7,988,263 | B2 | 8/2011 | Seto et al. |
| 8,083,318 | B2 | 12/2011 | Tsuchii et al. |
| 8,083,325 | B2 | 12/2011 | Inoue et al. |
| 8,162,446 | B2 | 4/2012 | Tomizawa et al. |
| 8,201,925 | B2 | 6/2012 | Saito et al. |
| 8,342,658 | B2 | 1/2013 | Tsuchii et al. |
| 2008/0165228 | A1 | 7/2008 | Kang et al. |
| 2009/0040273 | A1 * | 2/2009 | Tsuchii et al. ..... 347/47 |
| 2010/0045719 | A1 | 2/2010 | Akama et al. |
| 2010/0201748 | A1 | 8/2010 | Kishikawa et al. |
| 2010/0201753 | A1 | 8/2010 | Saito et al. |
| 2011/0239462 | A1 | 10/2011 | Saito et al. |
| 2012/0056940 | A1 | 3/2012 | Sakurai et al. |
| 2013/0088547 | A1 | 4/2013 | Tsuchii et al. |

FOREIGN PATENT DOCUMENTS

| | | | |
|---|---|---|---|
| CN | 1449917 | A | 10/2003 |
| CN | 101259789 | A | 9/2008 |
| JP | 2009-039914 | A | 2/2009 |
| JP | 2010-201921 | A | 9/2010 |

OTHER PUBLICATIONS

Search Report dated Aug. 8, 2012, in European Application No. 12002320.5.
Office Action in Chinese Patent Application No. 201210134163.X, dated Apr. 1, 2014.

* cited by examiner

*Primary Examiner* — Justin Seo
(74) *Attorney, Agent, or Firm* — Fitzpatrick, Cella, Harper & Scinto

(57) ABSTRACT

The liquid ejection head capable of securing a high performance of supplying liquid through supply ports while reducing the size of the substrate is provided. The liquid ejecting apparatus using such a liquid ejection head are also provided. The third supply ports situated between the first ejection port array and the second ejection port array include a portion of a large dimension and a portion of a small dimension.

7 Claims, 6 Drawing Sheets

LIQUID EJECTION HEAD AND LIQUID EJECTING APPARATUS

BACKGROUND OF THE INVENTION

1. Field of the Invention

The present invention relates to a liquid ejection head capable of ejecting liquid contained in a pressure chamber from ejection ports by using energy produced by energy generation elements, and to a liquid ejecting apparatus using the same.

2. Description of the Related Art

An example construction of this kind of liquid ejection head is taken from Japanese Patent Laid-Open No. 2009-39914. A print head (liquid ejection head) 71 as shown in FIGS. 6A and 6B has a print substrate 72 and top plate 73 joined together. The top plate 73 is formed with a plurality of ejection ports 78 arranged in two arrays LA-1, LA-2. The print substrate 72 has supply ports 74A, 74B, 74C formed therein in three supply port arrays LB-1, LC, LB-2. Ink (liquid) supplied from the supply ports 74 (74A, 74B, 74C) flows through cylindrical filters 80 into ink paths 77 formed between path walls 76. The ink in the ink path 77 is heated by an electrothermal conversion element (heater) 79 as an energy generation element to form a bubble, and thereby being ejected from the corresponding ejection port 78. A portion of each ink path 77 between the election port 78 and the heater 79 has a role of a pressure chamber.

Such ink paths 77 in this type of print head 71 can be improved in an ink refilling performance by supplying ink to them from the supply ports 74 (74A, 74B, 74C) on both sides as shown in FIGS. 6A and 6B.

In serial scan type inkjet printing apparatuses (liquid ejecting apparatuses), an image is printed by the print head 71 ejecting ink from the ejection ports 78 according to print data as it moves in a main scan direction crossing the ejection port arrays LA-1, LA-2. To produce a high quality image, the distance between the ejection port arrays LA-1 and LA2 needs to be set at an integer times an image print resolution in the main scan direction. This imposes a limitation on the size in the main scan direction of the supply ports 74B on the supply port array LC, which in turn may force the dimension of the supply ports 74B in a direction perpendicular to the direction of extension of the supply port array LC to be set larger than is required by the ink supply performance, resulting in an increased overall size of the print substrate 72 and therefore an increased size and cost of the print head 71.

In a process of forming the plurality of supply ports 74 (74A, 74B, 74C) in the same print substrate 72 with dry etching, if the supply ports 74 to be etched differ in the opening area, they also differ in an etching rate, taking different times to complete the etch. As a result, the supply ports of small opening areas may be excessively etched, with their openings becoming larger than their intended sizes or shaped like a notch. For this reason, in forming the plurality of supply ports 74 in the same board 74 with dry etching, the supply ports need to be designed to have almost equal opening areas. When the supply ports 74B are set large in a direction perpendicular to the direction of extension of the supply port array LC to make their opening area large enough to maintain their ink supply performance, other supply ports 74A, 74C also need to be set correspondingly large in the opening area. This, however, will likely increase the size of the board 72, resulting in increased size and cost of the print head 71.

SUMMARY OF THE INVENTION

This invention provides a liquid ejection head capable of securing a high performance of supplying liquid through supply ports while reducing the size of a substrate. A liquid ejecting apparatus using such a liquid ejection head is also provided.

In the first aspect of the present invention, there is provided a liquid ejection head comprising:

a first supply port and a second supply port put apart from each other in a first direction and a third supply port situated between the first supply port and the second supply port in the first direction, the first, second and third supply port piercing through a substrate, a plurality of the first supply ports, a plurality of the second supply ports and a plurality of the third supply ports being arranged in a first supply port array, a second supply port array and a third supply port array, respectively, these arrays extending in a second direction crossing the first direction; and a first ejection port array of first ejection ports arrayed in the second direction and situated between the first supply port array and the third supply port array with respect to the first direction, and a second ejection port array of second ejection ports arrayed in the second direction and situated between the second supply port array and the third supply port array with respect to the first direction, liquid supplied from the first, second and third supply ports being ejected through the first and second ejection ports, wherein each of the third supply ports includes a first portion situated on the side of the first ejection port with respect to the first direction, a second portion situated on the side of the second ejection port with respect to the first direction and a third portion situated between the first portion and the second portion, and the first portion and the second portion are greater than the third portion in a dimension as measured in the second direction.

In the second aspect of the present invention, there is provided a liquid ejecting apparatus comprising:

a carriage able to mount the liquid ejection head according to claim 1;

a moving unit configured to move the carriage in the first direction;

a feeding unit configured to feed a liquid acceptable medium in the second direction;

a liquid supplying unit configured to supply liquid to the first, second and third supply ports; and a driving unit configured to drive the energy generation elements.

With this invention, the substrate having supply ports formed therein can be reduced in size while at the same time securing a high performance of supplying liquid through the supply ports. This allows the liquid ejection head to be supplied liquid stably and eject liquid from ejection ports accurately, ensuring high quality printed images.

Further features of the present invention will become apparent from the following description of exemplary embodiments (with reference to the attached drawings).

DESCRIPTION OF THE EMBODIMENTS

The embodiments of this invention will be described by referring to accompanying drawings.

First Embodiment

Figure 1A:
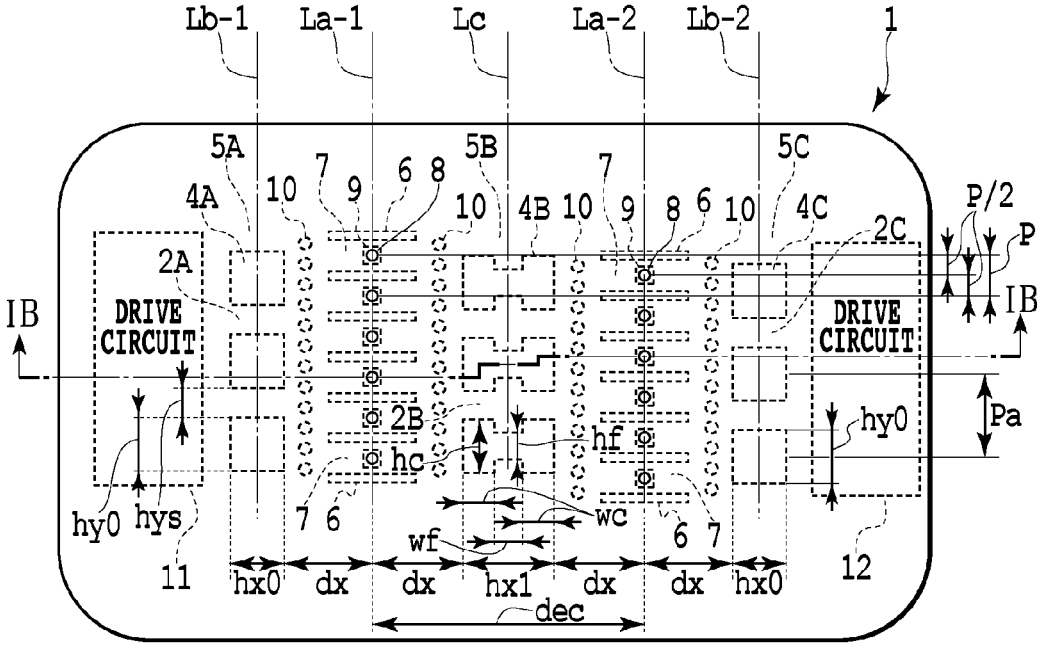
FIG. 1A is a plan view of an essential portion of an inkjet print head as a first embodiment of this invention.
Figure 1B:
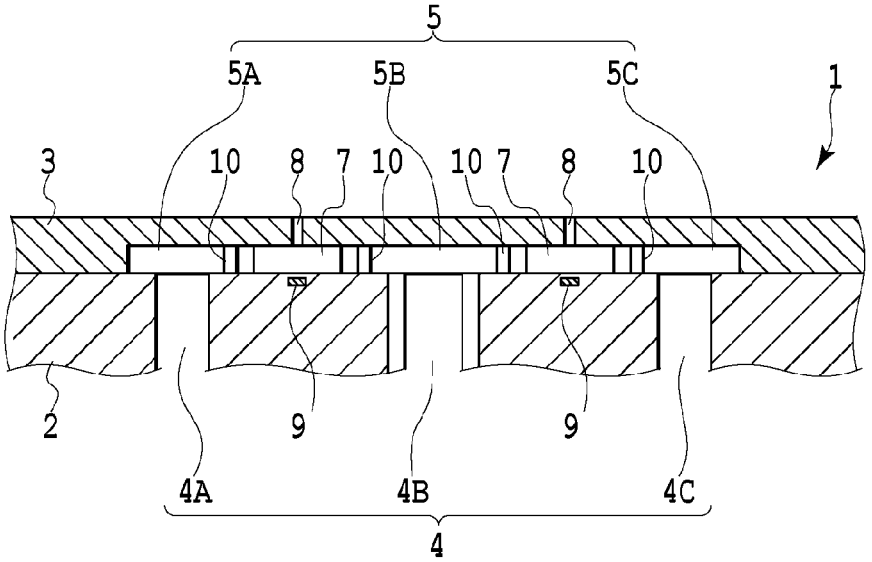
FIG. 1B is a cross section taken along line IB-IB in FIG. 1A.

FIG. 1A is a plan view of an essential portion of an inkjet print head (liquid ejection head) as the first embodiment of this invention. FIG. 1B is a cross section taken along the line IB-IB of FIG. 1A.

A print substrate 2 is formed with a plurality of ink supply ports 4 (4A, 4B, 4C) through which to introduce ink (liquid) into the inkjet print head 1. The ink supply ports 4A (first supply ports) are arrayed along a supply port array Lb-1 (first supply port array); the ink supply ports 4C (second supply ports) are arrayed along a supply port array Lb-2 (second supply port array); and the ink supply ports 4B (third supply ports) are arrayed in a supply port array Lc (third supply port array). These supply port arrays Lb-1, Lc, Lb-2 are arranged side by side in a horizontal direction in FIG. 1A (a first direction) and extend in a second direction crossing the first direction (in this example, at right angles). The ink supply ports 4A, 4B, 4C are communicated to common liquid chambers 5A, 5B, 5C, respectively, formed between the print substrate 2 and a top plate 3. Between the common liquid chambers 5A and 5B and between the common liquid chambers 5B and 5C are formed with a plurality of ink paths 7 defined by path walls 6. The top plate 3 is formed with ejection ports 8 at positions corresponding to the individual ink paths 7. The ejection ports 8 corresponding to the ink paths 7 between the common liquid chambers 5A and 5B (first ejection ports) are arrayed along the ejection port array (first ejection port array) La-1. The ejection ports 8 corresponding to the ink paths between the common liquid chambers 5B and 5C (second ejection ports) are arrayed along the ejection port array (second ejection port array) La-2. All these ejection ports 8 are arranged at the same pitch P, with those in the ejection port array La-1 staggered half a pitch P/2 from those in the ejection port array La-2.

The print substrate 2 has electrothermal conversion elements (heaters) 9 as energy generation elements, assigned one to each ejection port 8. The board 2 is also formed with drive circuits 11, 12 to control the energization of the heaters 9. Wires connecting the drive circuits 11, 12 and the heaters 9 may be formed in beam portions 2A of the board 2 situated between the ink supply ports 4A, in beam portions 2B of the board 2 between the ink supply ports 4B, and in beam portions 2C of the board 2 between the ink supply ports 4C.

As described above, the print head 1 of this embodiment is formed with two ejection port arrays La-1, La-2 and three supply port arrays Lb-1, Lc, Lb-2. Denoted 10 are cylindrical filters formed between the board 2 and the top plate 3 at positions between the common liquid chambers 5A, 5B, 5C and the ink paths 7.

The ink supplied to the ink supply ports 4 (4A, 4B, 4C) flows to the common liquid chambers 5 (5A, 5B, 5C), from which it further flows through the filters 10 into the ink paths 7 and forms an ink meniscus in each ejection port 8. The heater 9 is heated by a drive pulse from the drive circuits 11, 12 to form a bubble in the associated ink path 7, and thereby ejecting ink from the associated ejection port 8. The ink ejected from the ejection ports land on a print medium (liquid acceptable medium) to form ink dots so as to print a desired image on it. After ejecting ink, as the bubble contracts, the ink is again supplied from the common liquid chambers 5 (5A, 5B, 5C) to the associated ink paths 7. A portion of the ink path 7 situated between the ejection port 8 and the heater 9 functions as a pressure chamber to eject the ink by the force of an inflating bubble.

In this embodiment, the shape of the ink supply ports 4B is determined as follows. The ink supply ports 4B on the supply port array Lc between the ejection port arrays La-1 and La-2 are also referred to as "inner array supply ports", and the ink supply ports 4A, 4C on the supply port arrays Lb-1, Lb-2 outside the ejection port arrays La-1, La-2 as "outer array supply ports".

Distances between the center of each ejection port 8 and its adjacent ink supply ports 4 (4A, 4B, 4C) are set constant at dx. A referential mark hy0 represents dimensions of the outer array supply ports 4A, 4C as measured in the extending direction of the supply port arrays Lb-1, Lb-2; and hx0 represents dimensions of the outer array supply ports 4A, 4C as measured in a direction perpendicular to the supply port arrays Lb-1, Lb-2. A referential mark hys is dimensions (widths) of the beam portions 2A, 2B, 2C as measured in the extending direction of the supply port arrays Lb-1, Lc, Lb-2. Of the inner array supply ports 4B, a portion on the side of the ejection port array La-1 (first portion) and a portion on the side of the ejection port array La-2 (second portion) have a size hc in the extending direction of the supply port array Lc, and a portion between the first and the second portions (third portion) has a size hf in the same direction. The size hc is set larger than hf. That is, the size hc of the first portion on the side of the ejection port array La-1 (first ejection port side) and of the second portion on the side of the ejection port array La-2 (second ejection port side) is set large. A referential mark wc denotes a size of the first and second portions having the size hc of the inner array supply ports 4B as measured in the direction perpendicular to the supply port array Lc, and wf denotes a size of the third portion having the size hf as measured in the same direction. A referential mark dec represents a distance between the center of the ejection ports 8 on the ejection port array La-1 and the center of the ejection ports 8 on the ejection port array La-2.

The print head 1 of the above construction can be used in a serial scan type inkjet printing apparatus (liquid ejecting apparatus), as described later. In this example, a print resolution of the print head 1 in the main scan direction is 1,200 dpi, so the distance dec between the ejection port arrays is 168 μm, an integer times the distance of 21 μm that corresponds to the resolution of 1,200 dpi. The distance dx is 50 μm, and an arrangement pitch Pa of the ink supply ports 4 (4A, 4B, 4C) is 85 μm that corresponds to the print resolution of 300 dpi. The dimensions hy0 and hx0 of the outer array supply ports 4A, 4C are 50 μm (hy0=hx0=50 μm) and their opening areas are 2,500 $\mu m^2$ (=50×50 μm). Since the arrangement pitch Pa of the ink supply ports 4 (4A, 4B, 4C) is 85 μm for 300 dpi, the dimension hys of the beam portions 2A, 2B, 2C is 35 μm (=85−50 μm).

To dry-etch the board 2 to form the inner array supply ports 4B and the outer array supply ports 4A, 4C therein at the same time with high precision, the opening areas of the inner array supply ports 4B need to be set almost equal to those of the outer array supply ports 4A, 4C, or at about 2,500 $\mu m^2$. Because the dimension hx1 (=wc+wf+wc) of the inner array supply ports 4B is (dec−2dx), the dimension hx1 is 68 μm (=168−100 μm). If the opening of the inner array supply ports 4B is assumed to be rectangular in shape, or hc=hf, and their opening area is set at about 2,500 $\mu m^2$, the dimension of the inner array supply ports 4B in the vertical direction in FIG. 1A is 38 μm (≈2,500/68 μm). In that case, the dimension hys' of the beam portions 2B between the inner array supply ports 4B in the vertical direction of FIG. 1A is 47 μm (=85−38 μm), larger than the dimension hys of the beam portions 2A, 2C or 35 μm. This means that the area occupied by the beam portions 2B is larger than that of other beam portions 2A, 2C, increasing a resistance of ink flow from the inner array supply ports 4B to the ink paths 7. In this construction, if the ink is ejected continually from the ejection ports, the ink supply to the ejection ports may become insufficient.

To deal with this problem, the dimensions of the inner array supply ports 4B in this example are set at hc=50 μm, hf=20 μm, wc=19 μm and wf=30 μm. This allows the dimension hc of the inner array supply ports 4B on the ejection port array side to be set equal to the dimension hy0 of the outer array supply ports 4A, 4C, or 50 μm, while maintaining the opening areas of the inner array supply ports 4B at 2,500 $\mu m^2$ (=(50×19)×2+(20×30) μm). As a result, the ink flow resistance near the beam portions 2B of the inner array supply ports 4B can be maintained at almost the same ink flow resistance near the beam portions 2A, 2C of the outer array supply ports 4A, 4C. This in turn makes it possible to keep the ink flow to the individual ejection ports at an appropriate level, assuring a smooth supply of ink and a stable printing of high-quality images.

(Example Construction of Printing Apparatus)

Figure 2:
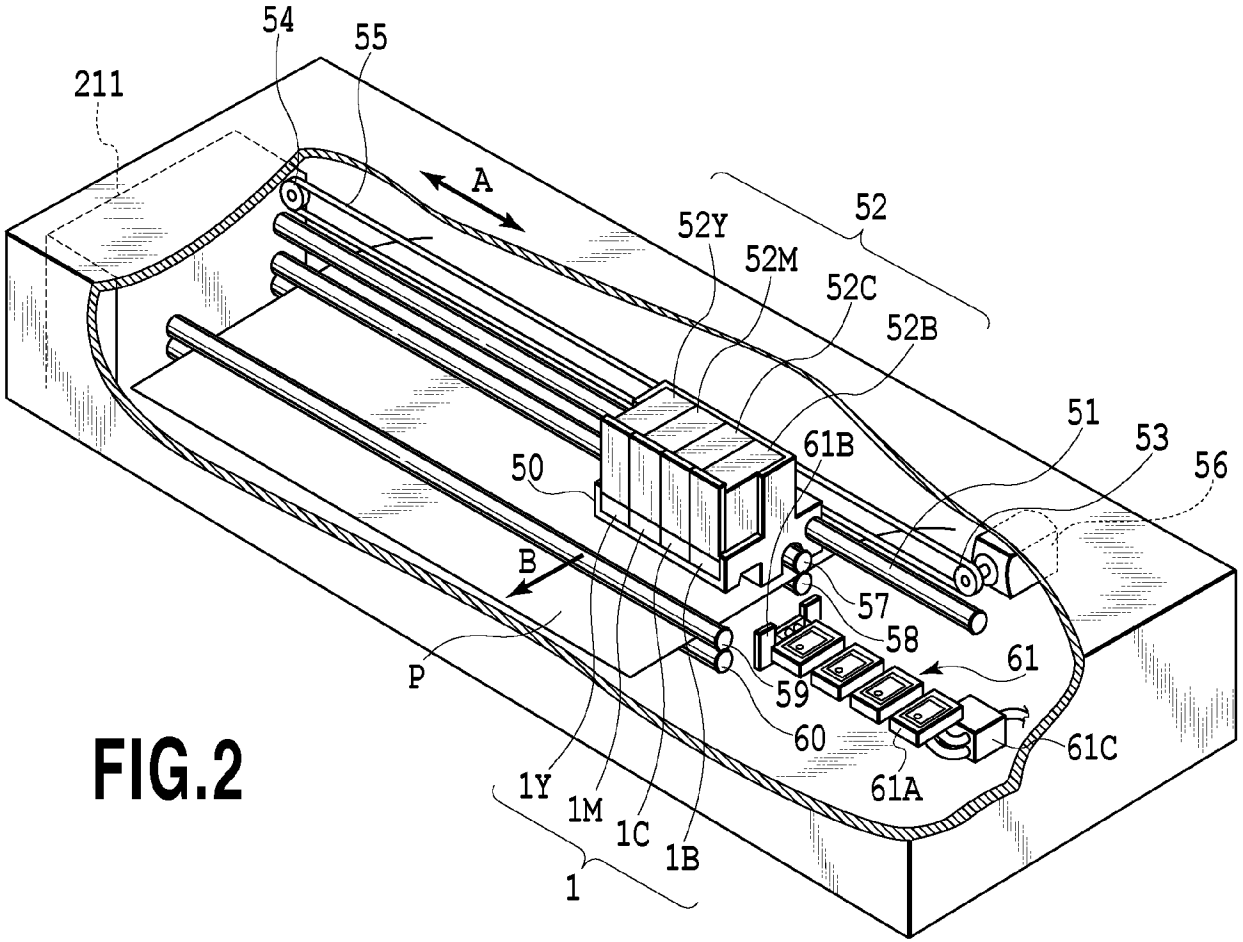
FIG. 2 is a schematic perspective view showing the construction of an inkjet printing apparatus that can apply the inkjet print head of FIG. 1A.

FIG. 2 is a perspective view showing an example construction of a serial scan type inkjet printing apparatus (liquid ejecting apparatus) to which the print head 1 of this embodiment can be applied.

A referential numeral 50 denotes a carriage that can mount the print head 1 and is supported on a guide shaft 51 to be able to reciprocate back and forth in a main scan direction indicated by an arrow A. The print head 1 is removably mounted on the carriage 50 so that the extending direction of the ejection port arrays La-1, La-2 crosses the main scan direction (in this example, at right angles). In this example, four print heads 1 (1Y, 1M, 1C, 1B) are mounted, each supplied one of four inks—yellow (Y), magenta (M), cyan (C) and black (B)—from an associated ink tank 52 (52Y, 52M, 52C, 52B). The four print heads 1 may be constructed as one integral print head or may each be combined with the associated ink tank 52 to form separate inkjet cartridges. Each of the print heads 1 (1Y, 1M, 1C, 1B) ejects ink (Y, M, C, K) from the associated ejection ports to form ink dots on a print medium (liquid acceptable medium), by selectively driving a plurality of heaters 9, as described earlier.

The carriage 50 is connected to a belt 55 that is stretched between and wound around pulleys 53 and 54, and is reciprocally moved in the main scan direction as the pulley 53 is rotated by a carriage motor 56. Paper P as the print medium is conveyed in a sub-scan direction, indicated by an arrow B, which crosses the main scan direction (in this example, at right angles). That is, the paper P is held between an upstream pair of rollers 57, 58 and a downstream pair of rollers 59, 60 and fed in the sub-scan direction, passing through a position facing the print head 1. The carriage 50 is moved, when necessary, to a home position where a recovery mechanism 61 is installed. The recovery mechanism 61 has a cap 61A, a blade 61B and a suction pump 61C to keep the ink ejection performance of the print head 1 in good condition.

Image printing consists in alternately repeating two operations: the printing operation of ejecting ink from the print head 1 while moving the print head 1 together with the carriage 50 in the main scan direction; and the paper feeding operation of feeding the paper P a predetermined distance in the sub-scan direction. The arrangement pitch of the ejection ports 8 on the ejection port arrays La-1, La-2 of the print head 1 is set according to the print resolution of an image in the sub-scan direction. The distance between the ejection port arrays La-1 and La-2, dec, is set to an integer times the print resolution of the image in the main scan direction. To print a high quality image, the distance between the ejection port arrays La-1 and La-2, dec, needs to be set so that it is equal to an integer times the print resolution in the main scan direction of the image data handled by the printing apparatus.

In the print head of this embodiment with the plurality of ejection port arrays La-1, La-2 formed between the plurality of supply port arrays Lb-1, Lc, Lb-2, the distance between the ejection port arrays, dec, is set to an integer times the print resolution. In that case, by setting the dimension hc of the inner array supply ports 4B larger than the dimension hf, it is possible to reduce the ink flow resistance while at the same time reducing the width hx1 of the inner array supply ports 4B. As a result, the print head can not only have its board 2 reduced in size but stably print high quality images.

Second Embodiment

Figure 3:
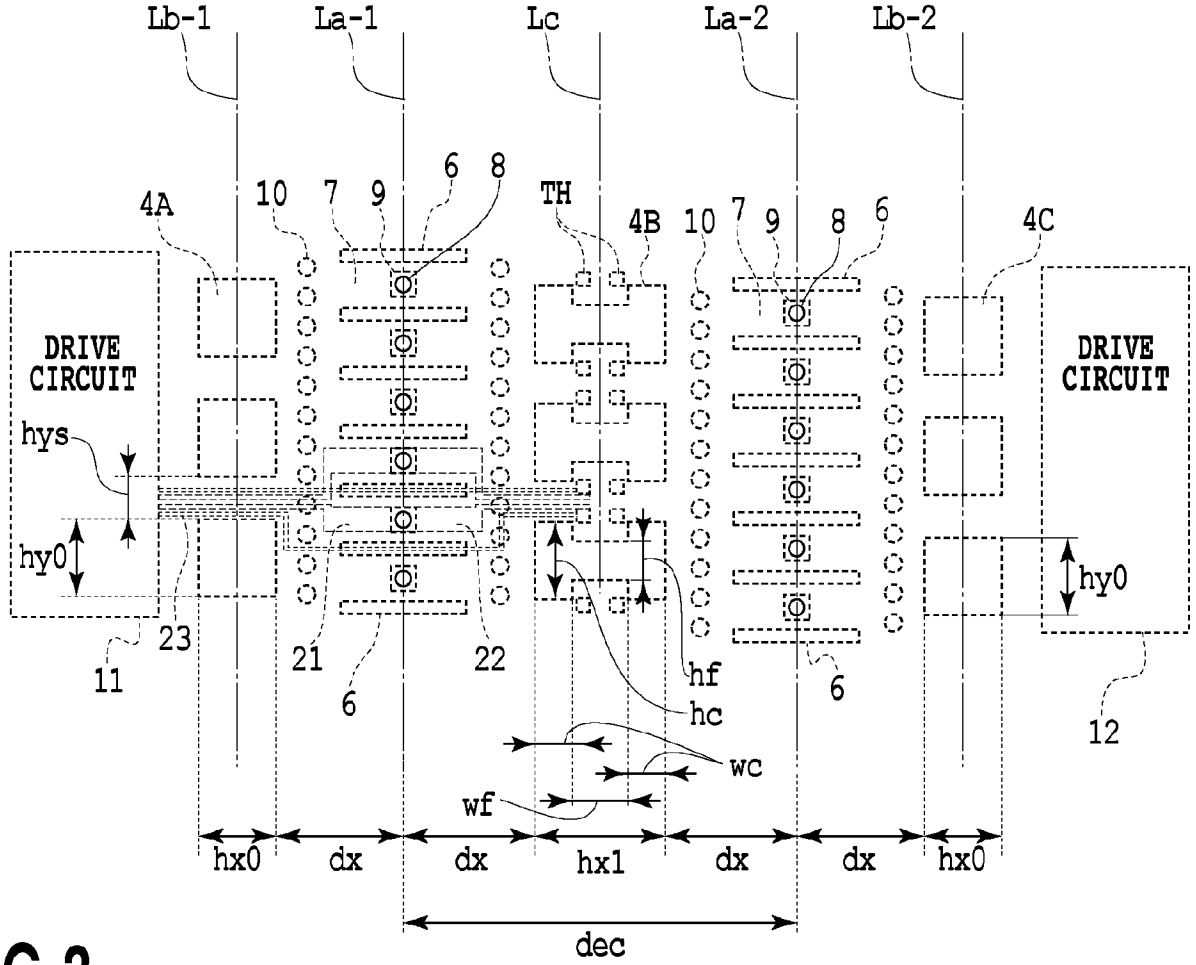
FIG. 3 is a plan view of an essential portion of an ink jet print head as a second embodiment of this invention.
Figure 4A:
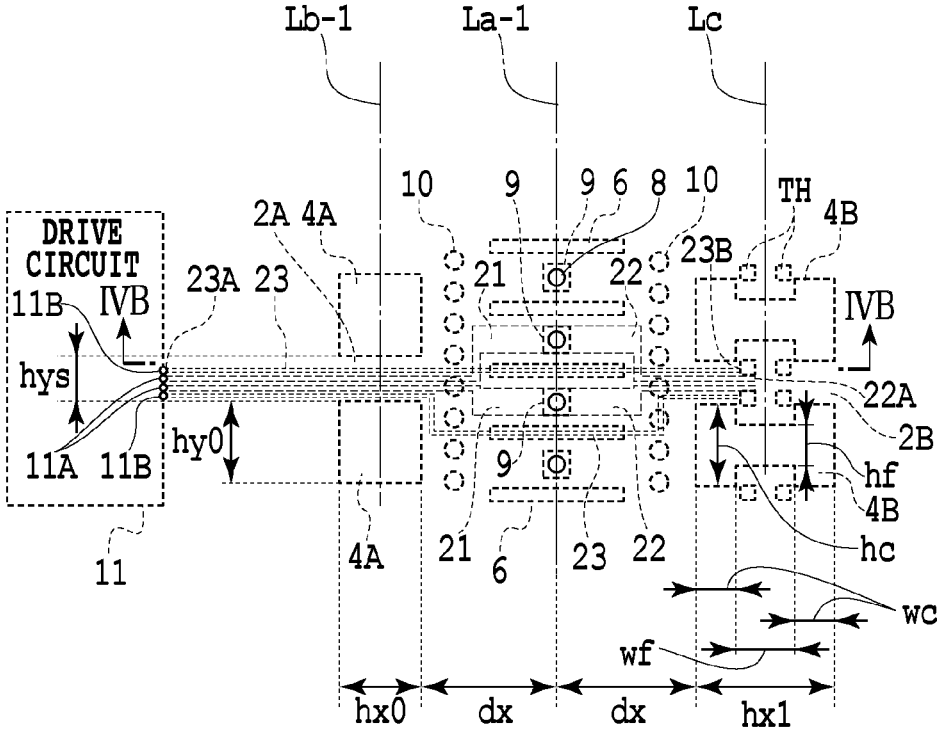
FIG. 4A is an enlarged view of a wired portion of the inkjet print head of FIG. 3.
Figure 4B:
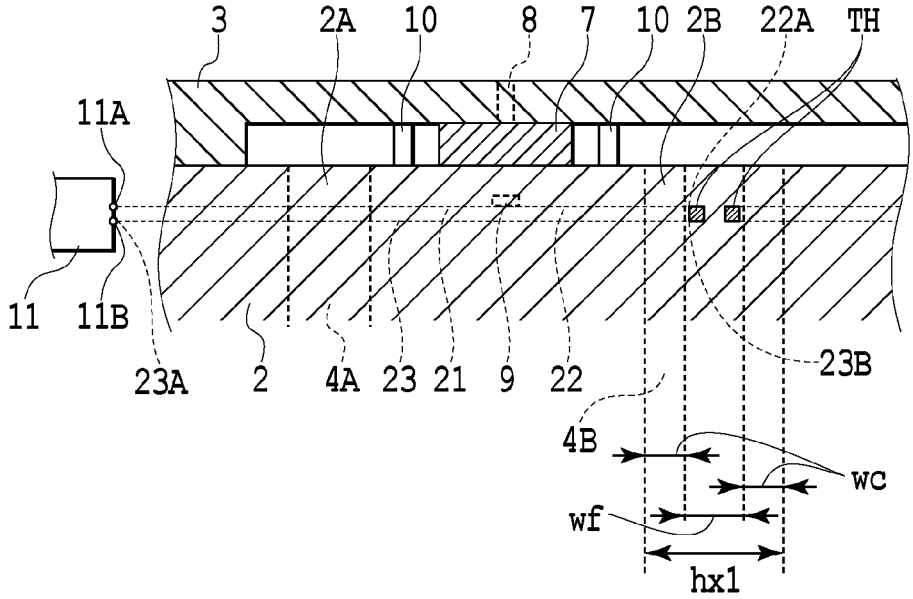
FIG. 4B is a cross section taken along line IVB-IVB of FIG. 4A.

FIGS. 3, 4A and 4B show a second embodiment of this invention. In this embodiment, the print substrate 2 is a multilayer board in which wiring between the drive circuits 11, 12 and the heaters 9 is multilayered, with through holes TH provided in a widened area of each beam portion 2B between the inner array supply ports 4B. Referring to FIG. 3 and FIG. 4A, the drive circuit 11 is formed at one of a pair of positions sandwiching the supply ports 4A in a horizontal direction (first direction) in FIG. 4A, and is on the opposite side of the supply ports 4A relative to supply ports 4B. The drive circuit 12 is formed at one of a pair of positions sandwiching the supply ports 4C in the horizontal direction in FIG. 4A, and is on the opposite side of the supply ports 4C relative to supply ports 4B.

One end of each of the heaters 9 along the ejection port array La-1 is connected with a first wire 21 and the other end with a second wire 22. These wires 21, 22 are formed in the same layer of the multilayer board 2, as shown in FIG. 4B. The first wire 21 extends from the one end of each heater 9 in the ejection port array La-1 toward the left in FIG. 4A, passing through the beam portion 2A between the outer array supply ports 4A to connect the one end of the heater 9 and a power supply terminal 11A of the drive circuit 11 (first drive circuit). The second wire 22 extends from the other end of each heater 9 in the ejection port array La-1 toward the right in FIG. 4A, with its front end 22A situated at the wf part of the beam portion 2B between the inner array supply ports 4B whose width is widened in the vertical direction of FIG. 4A. The wf part is a portion of the board 2 situated between a central part of an upper inner array supply ports 4B in FIG. 4B (constricted hf portion) and a central part of a lower inner array supply ports 4B in the same figure (constricted hf portion). The multilayer board 2 has third wires 23 formed in a different layer than that of the wires 21, 22. The third wires 23 are connected at one end 23A with a control terminal 11B of the drive circuit 11 and, at the other end 23B, face the end 22A of the second wires 22 and are connected to them through the through holes (first through holes) TH. In this example, the first and the second wires 21, 22 are formed on the upper layer in FIG. 4B and the third wires 23 on the lower layer. These wires may be formed on opposite layers. In FIG. 4A, although the first and the second wires 21, 22 are shown staggered from the third wire 23 for the sake of explanation, they may be laid out to overlap each other in FIG. 4A to narrow their wiring areas.

In the drive circuit 11, the power supply terminal 11A is connected to one end of a driving power source for the heater 9 and the control terminal 11B is connected to the other end of the driving power source through a drive transistor. When the drive transistor is turned on, a driving voltage VH is applied to the heater 9 which is then heated to eject ink from the associated ejection port 8, as described earlier.

This example construction provides a total of two sets of the first, second and third wire 21, 22, 23 in one beam portion 2A and one beam portion 2B in the board 2 for two adjacent heaters 2. These heaters 9 are connected to the individual power supply terminals 11A and control terminals 11B. The first wires 21 for the heaters 9 may be partly connected in common or connected to the common power supply terminal 11A.

Like the wiring between the drive circuit 11 and the heaters 9 along the ejection port array La-1, the heaters 9 in the ejection port array La-2 are connected through the wires 21, 22, 23 and the through holes (second through holes) TH to the drive circuit 12 (second drive circuit). FIG. 3 shows wiring only for the two heaters 9 along the ejection port array La-1.

In this embodiment, the through holes TH, relatively large when compared to the wiring, are situated in the wf parts of the beam portions 2B between the inner array supply ports 4B, i.e., in those parts of the beam portions 2B which are widened in the vertical direction of FIG. 4A. Therefore, these widened parts can be used as a space in which to form the through holes TH. In the inner array supply ports 4B, only the region wf corresponding to the position on the beam portion 2B where the through holes TH are formed may be set to the small dimension hf, with other regions wc given the larger dimension hc. This arrangement can minimize the flow resistance of ink while securing enough space for the through holes TH. With the through holes TH formed efficiently spacewise in the multilayer board 2, the print head able to stably print high quality images can be composed without increasing the size of the 2.

If the inner array supply ports 4B are not made smaller in one part thereof in the vertical direction of FIG. 4A as they are in the embodiment, the width hys of the beam portions 2B needs to be increased to secure enough space to form the through holes TH. This causes the flow resistance from the inner array supply ports 4B to the pressure chambers to become larger than that from the outer array supply ports 4A, 4C to the pressure chambers. More specifically, the ink flow resistance from the vicinity of the beam portions 2B to the pressure chambers becomes particularly large, giving rise to a possibility of ink supply failure and therefore disturbances in printed images.

Although an example construction with two ejection port arrays and three supply port arrays have been described, this embodiment can also be applied to a construction with greater numbers of ejection port arrays and supply port arrays. For example, in a construction with four ejection port arrays and five supply port arrays, each of the beam portions in a central supply port array may be formed with through holes for wiring a total of eight heaters, including two ejection port arrays on one side of the central supply port array and two ejection port arrays on the other side. This arrangement is able to produce the similar desirable effect.

Third Embodiment

Figure 5:
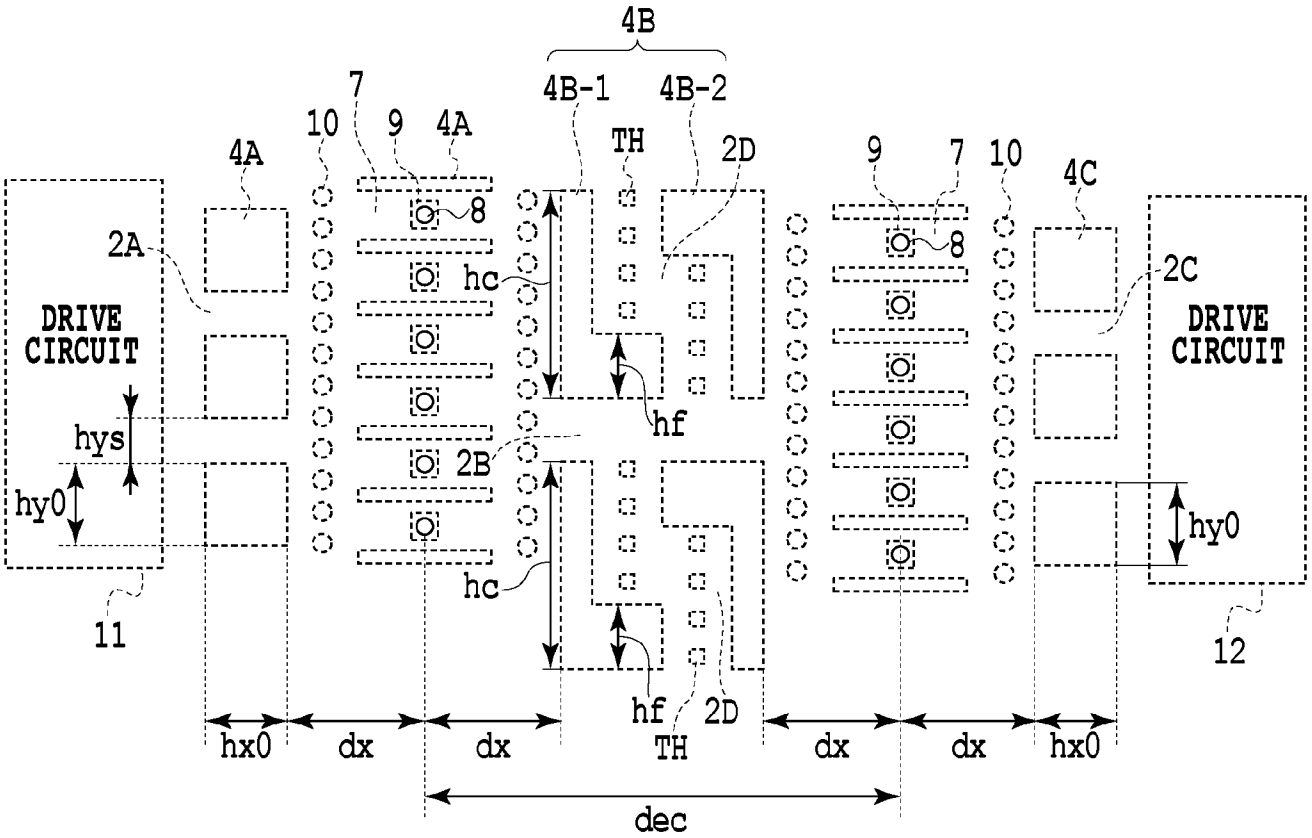
FIG. 5 is a plan view of an essential portion of an inkjet print head as a third embodiment of this invention.
Figure 6A:
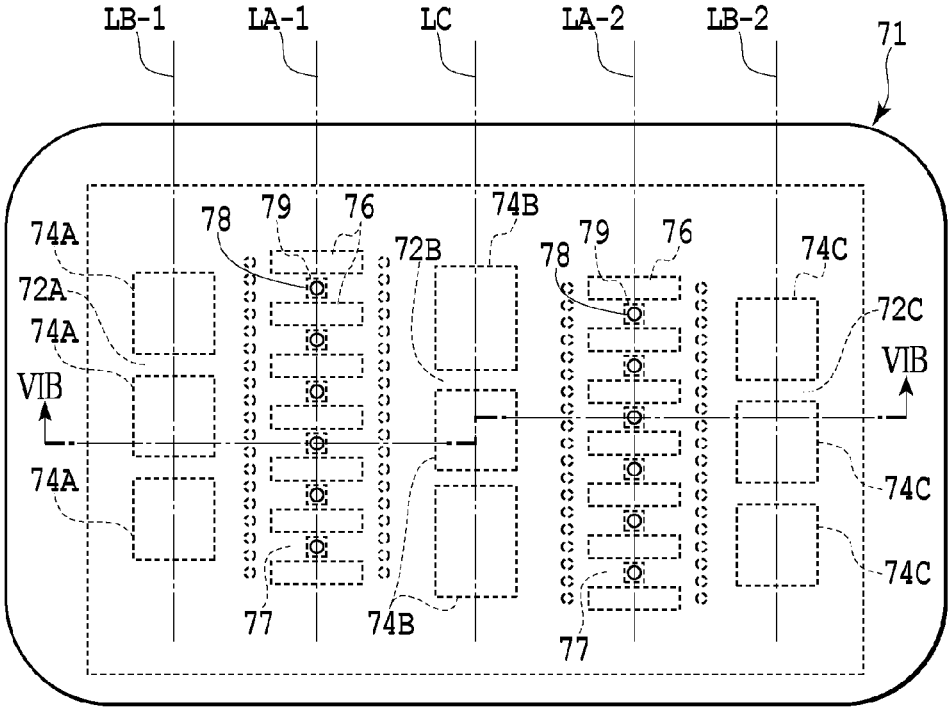
FIG. 6A is a plan view of an essential portion of a conventional inkjet print head.
Figure 6B:
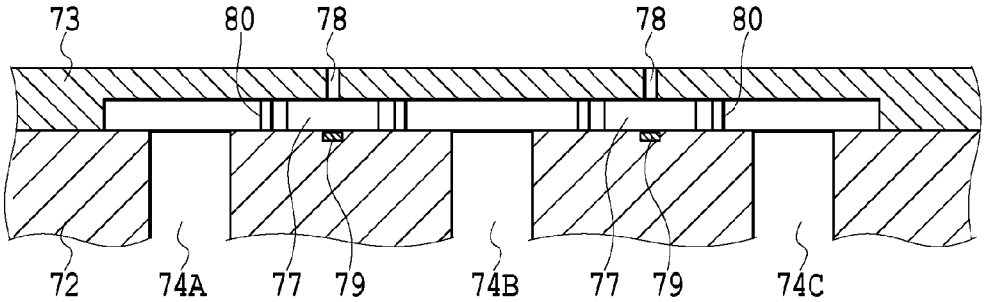
FIG. 6B is a cross section taken along line VIB-VIB of FIG. 6A.

FIG. 5 shows a third embodiment of this invention. In this embodiment, the inner array supply ports 4B each have a supply port 4B-1 near the outer array supply ports 4A (first supply ports) and a supply port 4B-2 near the outer array supply ports 4C (second supply ports). These supply ports 4B-1, 4B-2 are L-shaped in their opening and are point-symmetric to each other. A plurality of through holes TH are formed in each beam portion 2D situated between the supply ports 4B-1, 4B-2. These through holes TH, as in the second embodiment, are used to form the drive circuits for heaters 9 in the multilayer board 2. The area of each of the supply ports 4B-1, 4B-2 is almost equal to that of the outer array supply ports 4A, 4C.

With this embodiment the ink supply performance can further be improved by securing enough space for the through holes TH and at the same time increasing the size hc of the supply ports 4B-1, 4B-2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-101235, filed Apr. 28, 2011, which is hereby incorporated by reference herein in its entirety.

What is claimed is:

1. A liquid ejection head comprising:

first supply ports and second supply ports set apart from each other in a first direction, and third supply ports situated between the first supply ports and the second supply ports in the first direction, the first, second and third supply ports piercing through a substrate, a plurality of the first supply ports, a plurality of the second supply ports and a plurality of the third supply ports being arranged in a first supply port array, a second supply port array and a third supply port array, respectively, the first, second and third supply port arrays extending in a second direction crossing the first direction; and a first ejection port array of first ejection ports arrayed in the second direction and situated between the first supply port array and the third supply port array with respect to the first direction, and a second ejection port array of second ejection ports arrayed in the second direction and situated between the second supply port array and the third supply port array with respect to the first direction, liquid supplied from the first, second and third supply ports being ejected through the first and second ejection ports, wherein each of the third supply ports includes a first portion situated on the side of the first ejection ports with respect to the first direction, a second portion situated on the side of the second ejection ports with respect to the first direction and a third portion situated between the first portion and the second portion, and the first portion and the second portion are greater than the third portion in a dimension as measured in the second direction.

2. The liquid ejection head according to claim 1, wherein the substrate is formed with:

energy conversion elements each installed at a position corresponding to a different one of the ejection ports to convert energy for ejecting the liquid;

a first drive circuit provided at the opposite side of the first supply ports relative to the third supply ports with respect to the first direction, the first drive circuit being adapted to drive the energy conversion elements arranged along the first ejection port array; and a second drive circuit provided at the opposite side of the second supply ports relative to the third supply ports with respect to the first direction, the second drive circuit being adapted to drive the energy conversion elements arranged along the second ejection port array.

3. The liquid ejection head according to claim 2, wherein the substrate is formed with:

first wires passing through portions of the substrate, each located between adjoining first supply ports that are arrayed in the second direction, to connect the energy conversion elements arrayed along the first ejection port array to the first drive circuit; and second wires passing through portions of the substrate, each located between adjoining second supply ports that are arrayed in the second direction, to connect the energy conversion elements arrayed along the second ejection port array to the second drive circuit.

4. The liquid ejection head according to claim 3, wherein the substrate is a multilayer board, wherein each of the first and second wires includes upper and lower wire portions formed in different layers of the substrate, and wherein first through-holes to connect the upper and lower wire portions of the first wires and second through-holes to connect the upper and lower wire portions of the second wires are formed in portions of the substrate, each of the first and second through-holes being located between adjoining third supply ports that are arrayed in the second direction.

5. The liquid ejection head according to claim 1, wherein the third supply ports are each formed as two separate supply ports set apart in the first direction, one of the two separate supply ports including the first portion and the third portion, the other of the two separate supply ports including the second portion and the third portion.

6. The liquid ejection head according to claim 5, wherein the substrate is a multilayer board, wherein the substrate is formed with:

energy conversion elements each installed at a position corresponding to a different one of the ejection ports to convert energy for ejecting the liquid;

a first drive circuit provided at the opposite side of the first supply ports relative to the third supply ports with respect to the first direction, the first drive circuit being adapted to drive the energy conversion elements arranged along the first ejection port array;

a second drive circuit provided at the opposite side of the second supply ports relative to the third supply ports with respect to the first direction, the second drive circuit being adapted to drive the energy conversion elements arranged along the second ejection port array;

first wires passing through portions of the substrate, each located between adjoining first supply ports that are arrayed in the second direction, to connect some of the energy conversion elements arrayed along the first ejection port array to the first drive circuit; and second wires passing through portions of the substrate, each located between adjoining second supply ports that are arrayed in the second direction, to connect some of the energy conversion elements arrayed along the second ejection port array to the second drive circuit, wherein each of the first and the second wires includes upper and lower wire portions formed in different layers of the substrate, and wherein first through-holes to connect the upper and lower wire portions of the first wires and second through-holes to connect the upper and lower wire portions of the second wires are formed in portions of the substrate, each of the first and second through-holes being located between the two separate supply ports of one of the third supply ports.

7. A liquid ejecting apparatus comprising:

a carriage able to mount the liquid ejection head according to claim 1;

a moving unit configured to move the carriage in the first direction;

a feeding unit configured to feed a liquid accepting medium in the second direction;

a liquid supplying unit configured to supply liquid to the first, second and third supply ports; and a driving unit configured to drive energy conversion elements formed in the substrate, each of the energy conversion elements being installed at a position corresponding to a different one of the ejection ports to convert energy for ejecting the liquid.

* * * * *